US006985806B2

(12) United States Patent
Stadler

(10) Patent No.: US 6,985,806 B2
(45) Date of Patent: Jan. 10, 2006

(54) METHOD FOR DETERMINING AN ESTIMATED VALUE OF A MASS FLOW IN THE INTAKE CHANNEL OF AN INTERNAL COMBUSTION ENGINE

(75) Inventor: Wolfgang Stadler, Ergoldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 149 days.

(21) Appl. No.: 10/624,416

(22) Filed: Jul. 22, 2003

(65) Prior Publication Data

US 2005/0021215 A1 Jan. 27, 2005

Related U.S. Application Data

(63) Continuation of application No. PCT/DE01/04929, filed on Dec. 27, 2001.

(30) Foreign Application Priority Data

Jan. 23, 2001 (DE) ..... 101 02 914

(51) Int. Cl.
*F02D 41/02* (2006.01)

(52) U.S. Cl. ..... 701/102; 701/104; 73/117.3

(58) Field of Classification Search ..... 701/102, 701/104, 108; 73/117.3, 118.2, 116
See application file for complete search history.

(56) References Cited

U.S. PATENT DOCUMENTS

| | | | | |
|---|---|---|---|---|
| 5,094,213 A | | 3/1992 | Dudek et al. | 123/478 |
| 5,205,260 A | | 4/1993 | Takahashi et al. | 123/494 |
| 5,889,204 A | * | 3/1999 | Scherer et al. | 73/118.2 |
| 6,697,729 B2 | * | 2/2004 | Wright | 701/104 |

FOREIGN PATENT DOCUMENTS

| | | | |
|---|---|---|---|
| DE | 39 38 898 A1 | | 5/1991 |
| DE | 198 44 637 C1 | | 10/1999 |
| DE | 198 25 305 A1 | | 12/1999 |
| EP | 0 886 725 B1 | | 3/1997 |
| JP | 2-5734 A | * | 1/1990 |
| JP | 9-228884 | * | 9/1997 |
| WO | WO97/35106 | | 9/1997 |

* cited by examiner

*Primary Examiner*—Hieu T. Vo
(74) *Attorney, Agent, or Firm*—Baker Botts L.L.P.

(57) ABSTRACT

A measured value (MAP_MES) of the pressure in a suction pipe is the command variable of a control loop. The regulating variable is an estimated value (MAP_EST) of the pressure in the suction pipe, the estimated value being determined according to the manipulated variable of the control loop. The manipulated variable is calculated according to the difference between the estimated value (MAP_EST) and a measured value (MAP_MES) of the pressure in the suction pipe and according to the temporal change of the measured value (MAP_MES) of the pressure in the suction pipe. An estimated value (MAF_EST) of the mass flow in the intake passage (1) is calculated according to the manipulated variable.

10 Claims, 2 Drawing Sheets

METHOD FOR DETERMINING AN ESTIMATED VALUE OF A MASS FLOW IN THE INTAKE CHANNEL OF AN INTERNAL COMBUSTION ENGINE

CROSS REFERENCE TO RELATED APPLICATION

This application is a continuation of copending International Application No. PCT/DE01/04929 filed Dec. 27, 2001 and claiming a priority date of Jan. 23, 2001, which designates the United States, and claims priority of German Patent Application No. 10102914.4 filed on Jan. 23, 2001.

TECHNICAL FIELD OF THE INVENTION

The invention relates to a method for determining an estimated value of a mass flow in the intake channel of an internal combustion engine.

BACKGROUND OF THE INVENTION

EP 0 886 725 B1 discloses a method for determining an estimated value of a mass flow in the cylinders of an internal combustion engine. In this case, the estimated value of the mass flow in the cylinders of the internal combustion engine is determined depending on a measured value of a mass flow upstream of a throttle valve in the intake channel, on the degree of opening of the throttle valve, on the rotational speed, on the crankshaft, on a measured value of the induction manifold pressure, and on further operating variables of the internal combustion engine. A dynamic model of the intake channel of the internal combustion engine is provided for this purpose. The dynamic model is corrected during operation, depending on the measured value of the mass flow in the intake channel and on a difference between a measured value and an estimated value of the induction manifold pressure, which difference is supplied to a controller, whose manipulated variable is used for correcting the dynamic model of the intake channel.

Under specific load conditions of the internal combustion engine—in particular in the case of an internal combustion engine with four cylinders—significant pulsations of the gas mass in the intake channel occur, and these pulsations can cause a significant corruption of the measurement signal of the mass flow meter. It is therefore known from EP 0 886 725 B1 that the measured value of the mass flow meter should not be used for correcting the dynamic model of the intake channel under these conditions. However, this can lead to a loss of precision when determining estimated values using the dynamic model of the intake channel.

SUMMARY OF THE INVENTION

The invention addresses the problem of establishing a method for determining an estimated value of a mass flow in the intake channel of an internal combustion engine, which method is also highly precise when pulsations of the mass flow occur in the intake channel.

The problem can be solved by a method for determining an estimated value of a mass flow in the intake channel of an internal combustion engine, comprising the steps of:

determining a measured value of an induction manifold pressure as the command variable of a control loop, determining an estimated value of the induction manifold pressure as a regulating variable of the control loop, determining the estimated value depending on a manipulated variable of the control loop, calculating the manipulated variable depending on the difference between the estimated value and a measured value of the induction manifold pressure and depending on the time-related change of the measured value of the induction manifold pressure, and calculating the estimated value of the mass flow in the intake channel depending on the manipulated variable.

The manipulated variable can be calculated by multiplying the difference between the estimated value and the measured value of the induction manifold pressure by a correction factor, which factor is determined depending on the time-related change in the measured value of the induction manifold pressure. The correction factor can be determined from a characteristic curve. The manipulated variable can be corrected depending on a measured value of the air mass flow. The manipulated variable can be determined depending on the integral of the difference between the estimated value and the measured value of the induction manifold pressure.

The object can also be achieved by a device for determining an estimated value of a mass flow in the intake channel of an internal combustion engine, comprising a sensor for measuring the value of an induction manifold pressure which is used as the command variable of a control loop. The control loop may comprise an estimation unit for estimating the value of the induction manifold pressure which is used as a regulating variable of the control loop, wherein the estimation unit receives a manipulated variable of the control loop, a calculating unit for calculating the manipulated variable depending on the difference between the estimated value and a measured value of the induction manifold pressure and depending on the time-related change of the measured value of the induction manifold pressure, and a calculating unit for calculating the estimated value of the mass flow in the intake channel depending on the manipulated variable.

The calculating unit for calculating the manipulated variable may comprise a multiplier for multiplying the difference between the estimated value and the measured value of the induction manifold pressure by a correction factor, which factor is determined depending on the time-related change in the measured value of the induction manifold pressure. The correction factor can be determined from a characteristic curve. The device may further comprise a air mass flow sensor for providing a variable for correcting the manipulated variable. The calculating unit for calculating the manipulated variable may comprise an integrator for determining the integral of the difference between the estimated value and the measured value of the induction manifold pressure.

BRIEF DESCRIPTION OF THE DRAWINGS

Exemplary embodiments of the invention are explained in greater detail with reference to the schematic drawings in which.

DETAILED DESCRIPTION OF THE PREFERRED EMBODIMENTS

Figure 1:
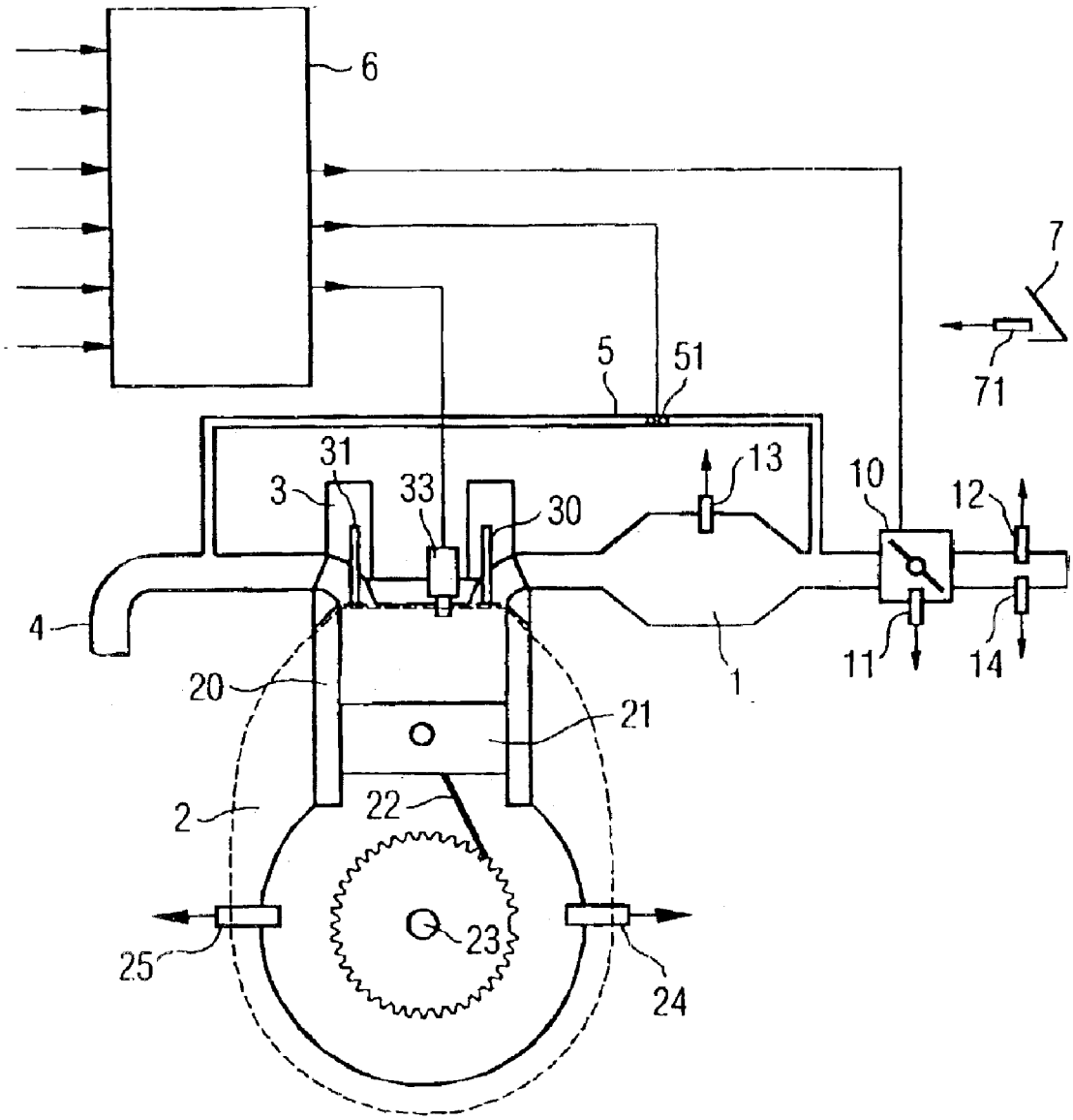
FIG. 1 shows an internal combustion engine with a control unit.

An internal combustion engine (FIG. 1) includes an intake channel 1, preferably with a throttle valve 10, and with an engine block 2, which has a cylinder 20 and a crankshaft 23. A piston 21 and a connecting rod 22 are assigned to the cylinder 20. The connecting rod 22 is connected to the piston and the crankshaft 23.

Provision is made for a cylinder head 3 in which a valve gear having at least one inlet valve 30 and one outlet valve 31 is arranged. A fuel injector 33 is additionally incorporated in the cylinder head 3. Alternatively, the fuel injector 33 can also be arranged in the intake channel 1. The internal combustion engine is shown in FIG. 1 with one cylinder. It can however include a plurality of cylinders.

Provision is also made for an exhaust channel 4, which is connected to the intake channel 1 via an exhaust return 5. An AGR valve 51 for setting the returned exhaust mass is arranged in the exhaust return 5. A mass flow meter, which captures an exhaust return mass flow M_EGR, can also be arranged in the exhaust return 5 if necessary.

Provision is also made for a control unit 6, to which sensors are assigned, which sensors capture various measured variables and determine the measured value of the measured variable in each case. Depending on at least one measured variable, the control unit 6 determines one or more actuating signals which control an actuating system in each case.

The sensors comprise a pedal position sensor 71 which captures a pedal value of the accelerator pedal 7; a throttle valve position sensor 11 which captures a degree of opening of the throttle valve 10; an air mass meter 12 which captures an air mass flow; an induction manifold pressure sensor 13 which captures an induction manifold pressure in the intake channel 1; a temperature sensor 14 which captures the intake-air temperature; a rotational speed sensor 24 which captures the rotational speed of the crankshaft 23; and a temperature sensor 25 which captures a cooling-medium temperature. Depending on the embodiment of the invention, any subsets of the aforementioned sensors or even additional sensors may be present.

The actuating systems comprise a servomechanism and an actuator in each case. The servomechanism is an electromotive drive, an electromagnetic drive, a piezoelectric drive, or a further drive which is known to the person skilled in the art. The actuators are designed as a throttle valve 10, a fuel injector 33 or an EGR valve 51. In the following, references to the actuating systems also refer to the actuator which is assigned in each case.

The control unit 6 is preferably designed as an electronic engine control. However, it can also include a plurality of control devices which are electrically connected to each other, e.g. via a bus system.

Figure 2:
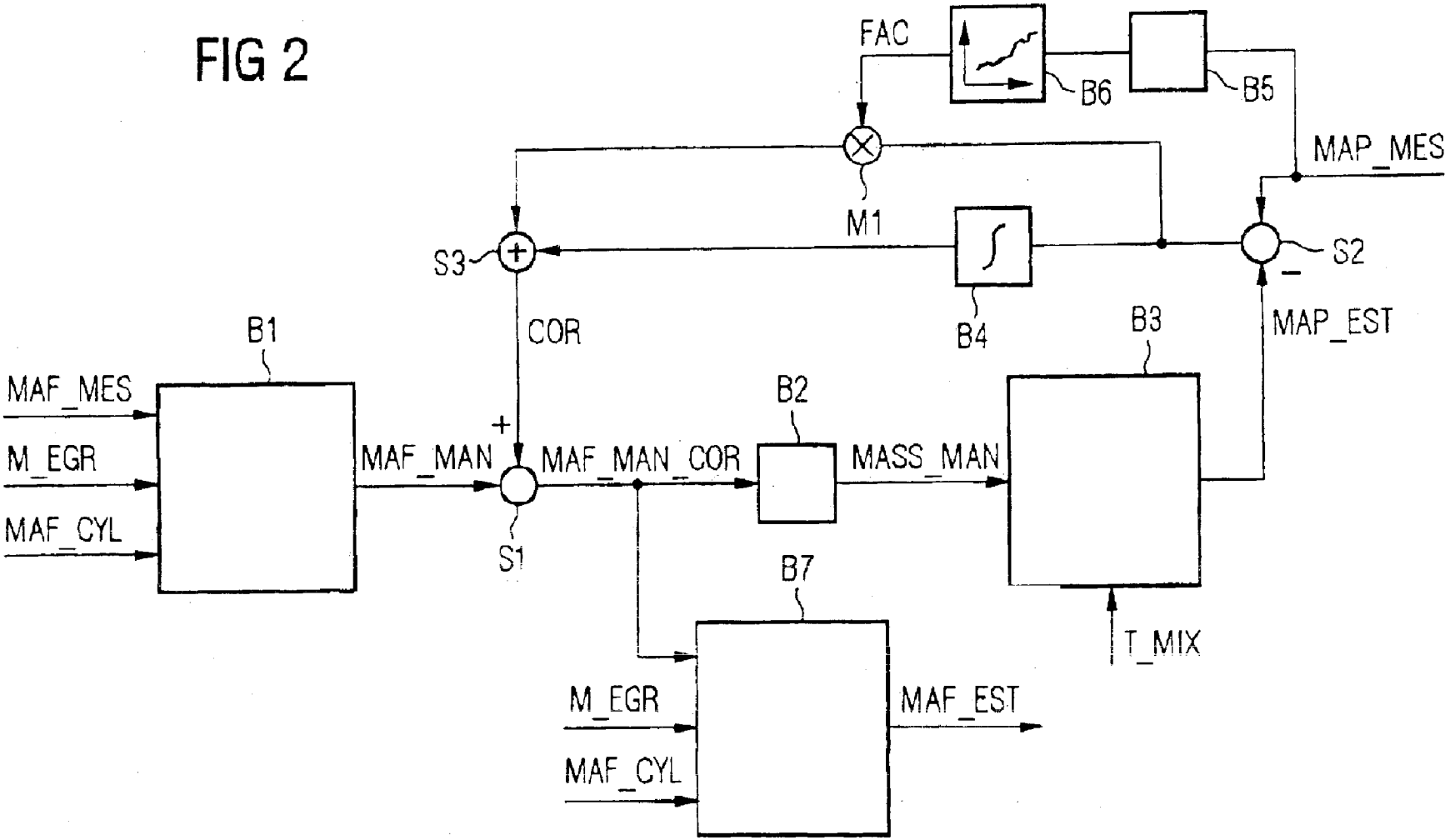
FIG. 2 shows a block schematic diagram of a part of the control unit, said part being relevant for the invention.

In a block B1 (FIG. 2), a MAF_MAN within the intake channel 1 is determined in accordance with the following relationship:

$$MAF_MAN=MAF_MES+M_EGR-MAF_CYL$$

where MAF_MES designates the measured value of the mass flow in the intake channel, which measured value is captured by the mass flow meter 12; M_EGR designates the exhaust return mass flow, which is either captured by the mass flow sensor in the exhaust return 5 or is calculated as an estimated value using a model; and MAF_CYL designates a mass flow in the cylinder 2 of the internal combustion engine, which mass flow is preferably determined using a dynamic model of the intake channel, as described in EP 0 886 725 B1, for example, the content of which is hereby included in relation to this.

In a summing point S1, the mass flow MAF_MAN within the intake channel 1 is corrected by adding the correction value COR which is described in detail below.

In a block B2, a gas mass MASS_MAN within the intake channel 1 is determined, depending on the corrected mass flow MAF_MAN_COR, by integrating the corrected mass flow MAF_MAN_COR over time.

In a block B3, an estimated value MAP_EST of the induction manifold pressure is determined in accordance with the following relationship:

$$\text{MAP_EST} = \frac{R}{VOL} \cdot TIA \cdot \text{MASS_MAN}$$

where R designates the general gas constants, VOL designates the volume of the intake channel downstream of the throttle valve as far as the inlet to the cylinders of the internal combustion engine, and TIA designates the intake air temperature or the temperature of the mass flow downstream of the throttle valve 10.

In a summing point S2, the difference between the measured value MAP_MES and the estimated value MAP_EST of the induction manifold pressure is calculated. The difference is then integrated in a block B4, and the integrated value is then supplied to the summing point S3.

In a block B5, a value is determined which is characteristic of the change in the measured value MAP_MES of the induction manifold pressure. The time-related derivative of the measured value MAP_MES of the induction manifold pressure is preferably determined in the block B5 for this purpose. This derivative then represents the input variable for a characteristic map, by means of which a correction factor FAC is determined in the block B6. In a multiplication point M1, the difference between the measured value MAP_MES and the estimated value MAP_EST of the induction manifold pressure is multiplied by the correction factor FAC. This value is then supplied to the summing point S3 and added to the integral which was determined in the block B4. This then produces the correction value COR.

In a block B7, an estimated value MAF_EST of the air mass flow in the intake channel of the internal combustion engine is determined depending on the corrected mass flow MAF_MAN_COR within the intake channel 1, the exhaust return mass flow M_EGR, and the mass flow MAF_CYL in the cylinder of the internal combustion engine. This is carried out using the following equation:

$$MAF_EST=MAF_MAN_COR-M_EGR+MAF_CYL.$$

The blocks B2, B3, B4, B5, B6 therefore form a control loop, in which the command variable is the measured value MAP_MES of the induction manifold pressure, in which the regulating variable is the estimated value MAP_EST of the induction manifold pressure, and in which the manipulated variable is the correction value COR, which is in turn corrected using the mass flow MAF_MAN within the intake channel 1, thus producing the corrected mass flow MAF_MAN_COR within the intake channel 1.

As a result of multiplying the difference between the measured value MAP_MES and the estimated value MAP_EST of the induction manifold pressure by the correction factor FAC, which is determined depending on the time-related change in the measured value MAP_MES of the induction manifold pressure, an extremely precise determination of the estimated value MAP_EST of the mass flow in the intake channel is ensured in an extremely simple manner, even under load conditions which include significant pulsations of the mass flow in the intake channel. In this case, the correction factor FAC is determined in advance by means of tests at an engine test bench, or by means of simulation, and stored in the characteristic curve.

In an alternative embodiment, the estimated value MAF_EST can even be determined without the mass flow MAF_MAN within the intake channel. The mass flow MAF_MAN within the intake channel is simply set to zero in this case, which corresponds to omitting the block B1. It is also possible, therefore, to determine a sufficiently precise estimated value MAF_EST of the mass flow in the intake channel in a simplified manner and without the calculations in the block B1. However, an inclusion of the block B1 has the advantage that, by calculating the mass flow MAF_MAN within the intake channel in the block B1, an approximate operating point is specified for the control loop as a form of advance control, and a precise estimated value MAF_EST of the mass flow in the intake channel is consequently provided more quickly, which is a significant advantage, particularly in the case of a dynamic running of the internal combustion engine.

The calculation of the integral of the measured value MAP_MES and of the estimated value MAP_EST of the induction manifold pressure has the advantage that it ensures a greater stationary accuracy of the estimated value MAF_EST. However, this can likewise be omitted in a simpler embodiment.

The estimated value MAF_EST of the mass flow can then be used for the further calculation of actuating signals for actuators of the internal combustion engine, or also for diagnosis.

What is claimed is:

1. A device for determining an estimated value of a mass flow in the intake channel of an internal combustion engine, comprising:

a sensor for measuring the value of an induction manifold pressure which is used as the command variable of a control loop, wherein the control loop comprises:

an estimation unit for estimating the value of the induction manifold pressure which is used as a regulating variable of the control loop, wherein the estimation unit receives a manipulated variable of the control loop, a calculating unit for calculating the manipulated variable depending on the difference between the estimated value and a measured value of the induction manifold pressure and depending on the time-related change of the measured value of the induction manifold pressure, and a calculating unit for calculating the estimated value of the mass flow in the intake channel depending on the manipulated variable.

2. The device as claimed in claim 1, wherein the calculating unit for calculating the manipulated variable comprises a multiplier for multiplying the difference between the estimated value and the measured value of the induction manifold pressure by a correction factor, which factor is determined depending on the time-related change in the measured value of the induction manifold pressure.

3. The device as claimed in claim 2, wherein the correction factor is determined from a characteristic curve.

4. The device as claimed in claim 1, further comprising a air mass flow sensor for providing a variable for correcting the manipulated variable.

5. The device as claimed in claim 1, wherein the calculating unit for calculating the manipulated variable comprises an integrator for determining the integral of the difference between the estimated value and the measured value of the induction manifold pressure.

6. A method for determining an estimated value of a mass flow in the intake channel of an internal combustion engine, comprising the steps of:

determining a measured value of an induction manifold pressure as the command variable of a control loop, determining an estimated value of the induction manifold pressure as a regulating variable of the control loop, determining the estimated value depending on a manipulated variable of the control loop, calculating the manipulated variable depending on the difference between the estimated value and a measured value of the induction manifold pressure and depending on the time-related change of the measured value of the induction manifold pressure, and calculating the estimated value of the mass flow in the intake channel depending on the manipulated variable.

7. The method as claimed in claim 6, wherein the manipulated variable is calculated by multiplying the difference between the estimated value and the measured value of the induction manifold pressure by a correction factor, which factor is determined depending on the time-related change in the measured value of the induction manifold pressure.

8. The method as claimed in claim 7, wherein the correction factor is determined from a characteristic curve.

9. The method as claimed in claim 6, wherein the manipulated variable is corrected depending on a measured value of the air mass flow.

10. The method as claimed in claim 1, wherein the manipulated variable is determined depending on the integral of the difference between the estimated value and the measured value of the induction manifold pressure.

* * * * *